US010051360B2

(12) United States Patent
Abbott et al.

(10) Patent No.: US 10,051,360 B2
(45) Date of Patent: Aug. 14, 2018

(54) AUDIO COMPONENT ASSEMBLY FOR AVIATION HELMETS AND THE LIKE

(71) Applicant: Ron Abbott, Charleston, SC (US)

(72) Inventors: Ron Abbott, Charleston, SC (US); Alex Abbott, Melbourne, FL (US)

(73) Assignee: Ron Abbott, Charleston, SC (US)

( * ) Notice: Subject to any disclaimer, the term of this patent is extended or adjusted under 35 U.S.C. 154(b) by 182 days.

(21) Appl. No.: 15/046,845

(22) Filed: Feb. 18, 2016

(65) Prior Publication Data

US 2017/0245043 A1 Aug. 24, 2017

(51) Int. Cl.

| | |
|---|---|
| ***H04R 1/10*** | (2006.01) |
| ***A42B 3/04*** | (2006.01) |
| *A42B 3/30* | (2006.01) |

(52) U.S. Cl.

CPC ..... *H04R 1/1066* (2013.01); *A42B 3/04* (2013.01); *H04R 1/1008* (2013.01); *A42B 3/30* (2013.01); *H04R 2201/107* (2013.01)

(58) Field of Classification Search

CPC .. H04R 1/1066; H04R 1/1075; H04R 1/1008; H04R 2201/107; A42B 3/04; A42B 3/0406; A42B 3/30

USPC ..... 381/376

See application file for complete search history.

(56) References Cited

U.S. PATENT DOCUMENTS 2,468,267 A * 4/1949 Mondl ..... H04R 1/1008 2/209
2,871,481 A * 2/1959 Gerstin ..... A42B 3/12 2/423
4,905,322 A * 3/1990 Aileo ..... A42B 3/166 181/129
5,136,657 A * 8/1992 Hattori ..... A42B 3/127 2/241
5,148,887 A * 9/1992 Murphy ..... A42B 3/166 181/129
5,603,117 A * 2/1997 Hudner, Jr. ..... A42B 3/127 2/423
6,154,890 A * 12/2000 Deopuria ..... A42B 3/16 181/129
6,157,298 A * 12/2000 Garfinkel ..... A42B 3/0453 340/463
6,970,691 B2 * 11/2005 Thompson ..... A42B 3/30 2/422
7,110,743 B2 * 9/2006 Depew ..... A42B 3/14 381/375
7,349,551 B2 * 3/2008 Skillicorn ..... H04B 1/385 381/376
2006/0057972 A1 * 3/2006 Wikel ..... A42B 3/30 455/90.3

(Continued)

*Primary Examiner* — Oyesola C Ojo

(74) *Attorney, Agent, or Firm* — Mendelsohn Dunleavy, P.C.; Steve Mendelsohn

(57) ABSTRACT

In one embodiment, an adapter for an audio component assembly of a helmet employing an apertured retention assembly. The adapter permits integration of audio components from an aftermarket headset, in place of one or more manufacturer-supplied audio components integrated into the helmet. The adapter includes a generally annular member adapted to retain an earpiece therein, and at least one flange disposed on an outer surface of the generally annular member. The at least one flange is adapted to retain the generally annular member by interference fit in an aperture formed in a retention assembly of the helmet.

18 Claims, 11 Drawing Sheets

(56) References Cited

U.S. PATENT DOCUMENTS

| | | | | |
|---|---|---|---|---|
| 2007/0261153 | A1* | 11/2007 | Wise | A42B 3/044 2/423 |
| 2009/0199326 | A1* | 8/2009 | Brauner | A42B 3/166 2/423 |
| 2010/0034418 | A1* | 2/2010 | Bonin | H04R 9/025 381/396 |
| 2013/0133128 | A1* | 5/2013 | Hein | A42B 3/166 2/423 |
| 2017/0150769 | A1* | 6/2017 | Lebel | A42B 3/30 |

* cited by examiner

AUDIO COMPONENT ASSEMBLY FOR AVIATION HELMETS AND THE LIKE

BACKGROUND

The disclosure relates, generally, to helmets, and more particularly, to the provision of audio signals to wearers of helmets, such as aviation helmets.

Aviation helmets, such as the Gentex® SPH-5™ Rotary Wing Helmet, generally include a rigid outer shell (made, e.g., from a graphite-nylon composite) with integrated audio components used by aircrew during flight for communications. The audio components in the helmet interface with radio communications or other audio equipment of an aircraft via physical wiring or wireless communications. The audio components typically include left and right earpieces to provide audio signals to the wearer of the helmet, and a microphone to receive audio signals from the wearer of the helmet.

Although aviation helmets are manufactured to include earpieces and a microphone, these audio components can suffer from wear and often need replacement. Some wearers of aviation helmets wish to replace manufacturer-supplied earpieces with earpieces that are a more comfortable fit for the wearer's head. Other wearers of aviation helmets wish to replace manufacturer-supplied microphones and/or earpieces with those that can deliver higher audio quality.

Conventionally, the only option for the consumer to replace aviation helmet audio components was to use replacement components having identical or similar specifications to those original manufacturer-supplied components being replaced—i.e., having the same uncomfortable fit and/or undesirable audio fidelity.

SUMMARY

Embodiments of the disclosure provide audio component assemblies for use in a helmet that employs an apertured retention assembly, such as a helicopter or other aviation helmet. The audio component assemblies integrate audio components from an aftermarket headset, allowing those audio components to be used in the helmet reliably, in place of one or more manufacturer-supplied audio components integrated into the helmet.

Embodiments of the disclosure also provide adapters and sets of adapters for integrating audio components from an aftermarket headset into an aviation or other helmet that employs an apertured retention assembly.

Embodiments of the disclosure also provide methods for integrating audio components from an aftermarket headset into an aviation or other helmet that employs an apertured retention assembly.

In one embodiment, the present disclosure provides an adapter for an audio component assembly of a helmet. The adapter includes a generally annular member adapted to retain an earpiece therein, and at least one flange disposed on an outer surface of the generally annular member. The at least one flange is adapted to retain the generally annular member by interference fit in an aperture formed in a retention assembly of the helmet.

In another embodiment, the present disclosure provides an adapter set for an audio component assembly of a helmet. The adapter set includes first and second generally annular members. The first generally annular member is adapted to retain a left earpiece therein, and the second generally annular member is adapted to retain a right earpiece therein. At least one of the first and second generally annular members includes an inner ring and an outer ring. The inner ring is adapted to retain the earpiece therein by means of at least one projection or peg protruding from an inner surface of the inner ring. The outer ring is detachably coupled to the inner ring and is adapted to retain the outer ring in the aperture. At least one flange is disposed on an outer surface of the generally annular member. The at least one flange is adapted to retain the outer ring by interference fit in an aperture formed in a retention assembly of the helmet.

In a further embodiment, the present disclosure provides a method for constructing an audio component assembly for a helmet. The method includes: (a) retaining an earpiece within a generally annular member; and (b) retaining the generally annular member by interference fit in an aperture formed in a retention assembly of the helmet. The interference fit is produced by at least one flange disposed on an outer surface of the generally annular member.

DESCRIPTION

Figure 1:
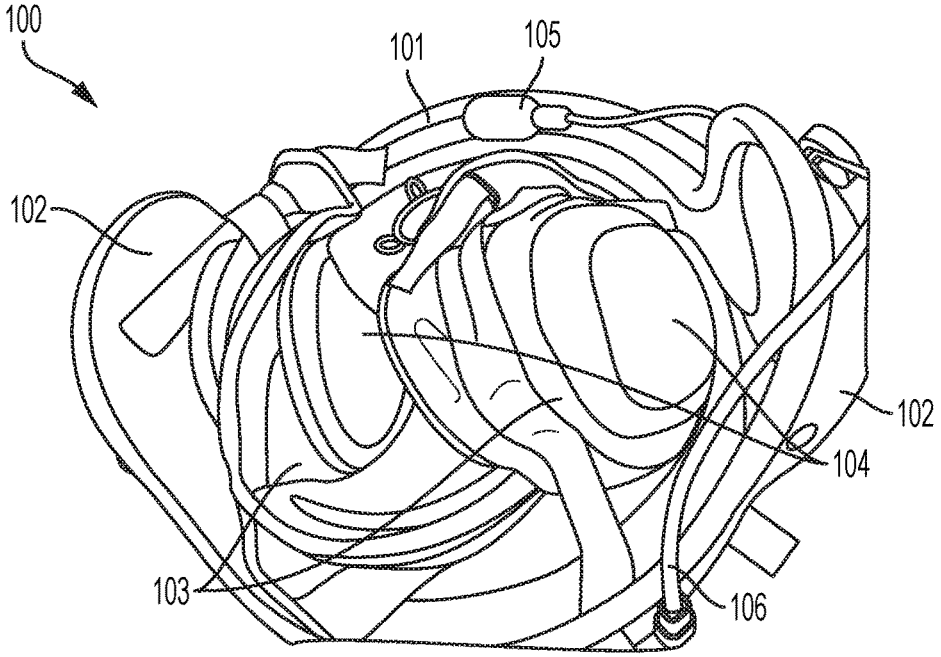
FIG. 1 shows a perspective view of one side and the underside of an aviation helmet, in one embodiment of the disclosure.

Turning first to FIG. 1, a helmet 100, in one embodiment of the disclosure, is shown. Helmet 100 may be an aviation helmet, such as a Gentex® SPH-5™ Rotary Wing Helmet, or may be another type of helmet, such as a motorcycle helmet. Helmet 100 includes a rigid outer shell 101 made, e.g., from a graphite-nylon composite, and formed with a pair of ear plates 102 designed to cover the ears of a wearer. Helmet 100 has integrated audio components used by aircrew during flight for communications, which interface with radio communications or other audio equipment of an aircraft via physical cables (e.g., wiring 106), although in some embodiments, wireless communications are employed. The audio components include left and right earpieces 104 to provide audio signals to the wearer of the helmet, and a microphone 105 to receive audio signals from the wearer of the helmet. Earpieces 104 are held in place by an apertured retention assembly 103 that has left and right portions abutting ear plates 102 of helmet 100.

In the event a replacement of one or more of the audio components is desired, some wearers of aviation helmets wish to replace the manufacturer-supplied audio components with aftermarket audio components. This might be for the purpose of using earpieces that are a more comfortable fit for the wearer's head, or to replace manufacturer-supplied microphones and/or earpieces with those that can deliver higher audio quality, or to replace a poorly-functioning or non-functional microphone and/or earpiece, or the like. Consumers were previously able to replace aviation helmet audio components only with replacement components having identical or similar specifications to those original manufacturer-supplied components being replaced—i.e., having the same uncomfortable fit or undesirable audio fidelity.

Figure 2:
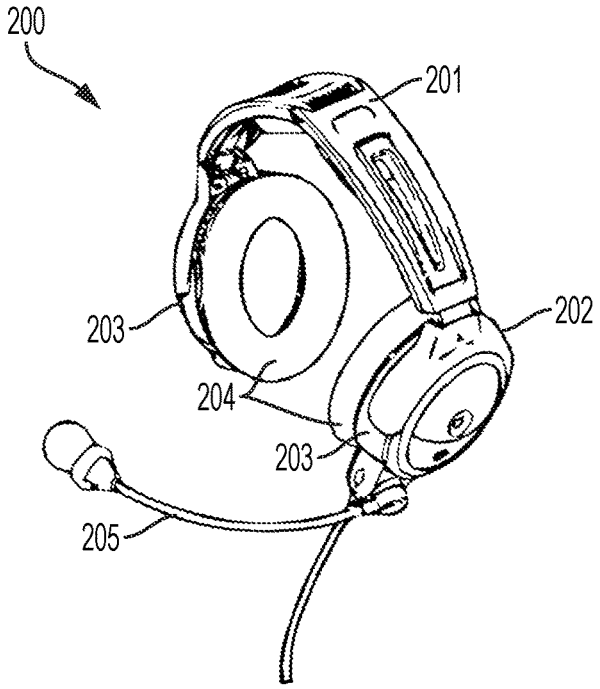
FIG. 2 shows a top-front perspective view of a headset, in one embodiment of the disclosure.

FIG. 2 shows an aftermarket headset 200, in one embodiment of the disclosure. As shown, headset 200 includes left and right earpieces 203, with each having a respective earcup 204, and a microphone 205 coupled to one of earpieces 203. Earpieces 203 and microphone 205 may be coupled to one another via wiring (not shown). For structural support over the head of a wearer, earpieces 203 are coupled to one another via a headband 201 that has a retaining member 202 at each end, so as to allow earpieces 203 to maintain an appropriate height relative to the wearer's ears during use.

Figure 3:
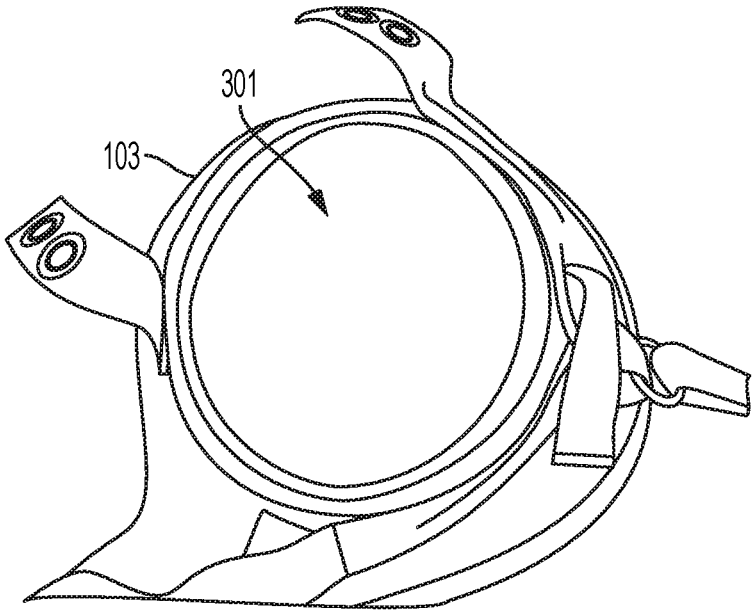
FIG. 3 shows a side perspective view of an apertured portion of a retention assembly, in one embodiment of the disclosure.
Figure 4:
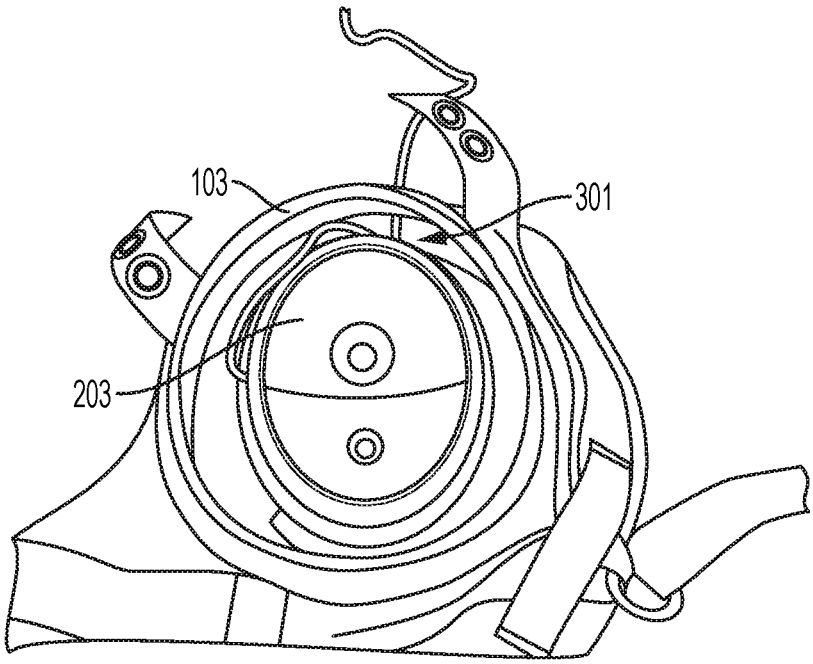
FIG. 4 shows a size discrepancy between an aftermarket earpiece and the apertured portion of the retention assembly of FIG. 3 within which the aftermarket earpiece is depicted.

As shown in FIG. 3, it is possible to remove earpieces 104 from retention assembly 103 of helmet 100 of FIG. 1, leaving an aperture 301. However, as FIG. 4 illustrates, aftermarket earpieces 203 are too small to fit snugly within aperture 301, making it difficult or impossible to safely or properly maintain earpieces 203 at the correct location adjacent to the wearer's ears.

Embodiments of the disclosure provide an audio component assembly that integrates the earpieces and microphone from an aftermarket headset, allowing those audio components to be used reliably in place of one or more manufacturer-supplied audio components integrated into the helmet.

Figure 5:
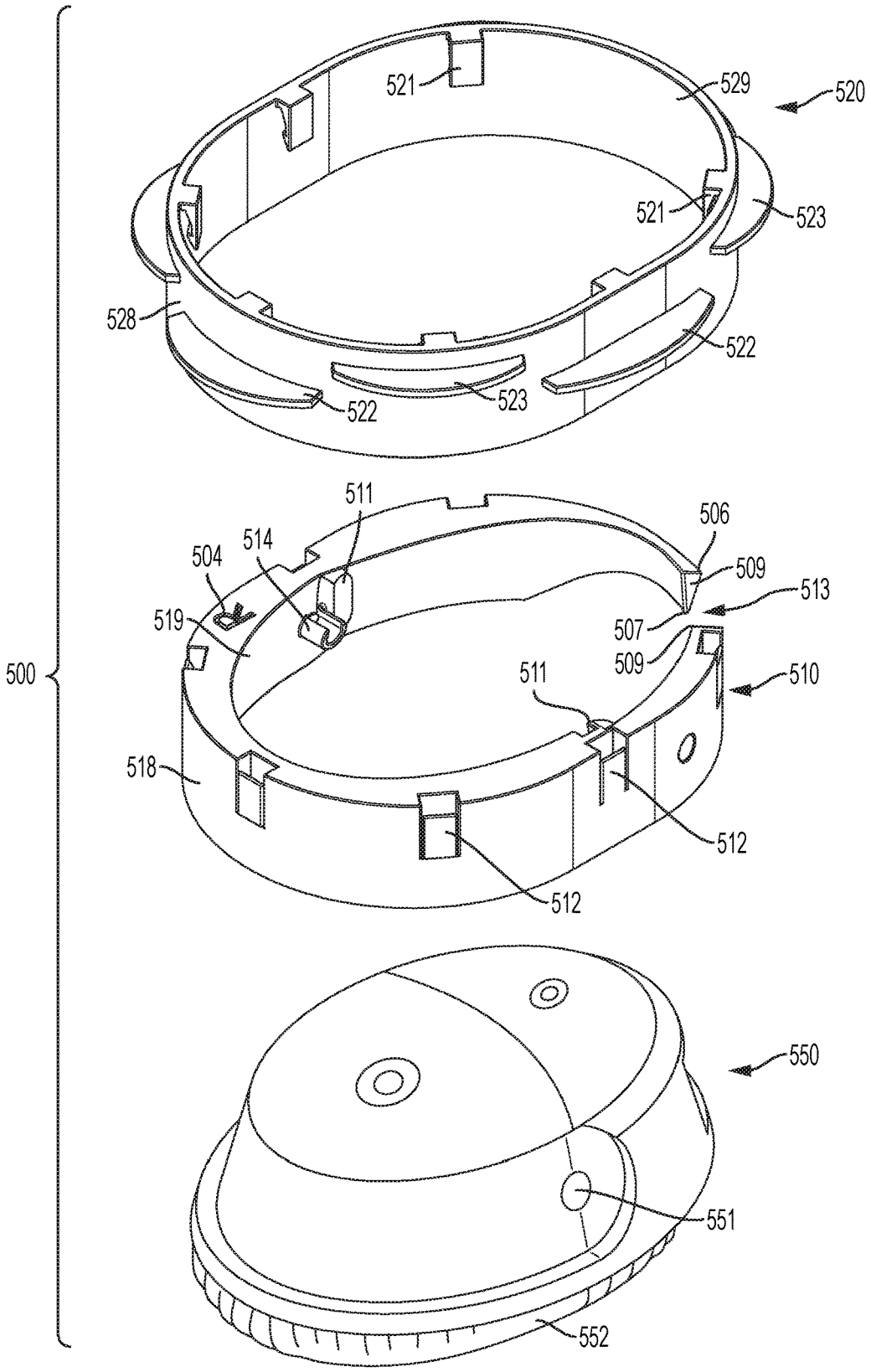
FIG. 5 shows an exploded view of a right audio component assembly, in one embodiment of the disclosure.
Figure 6:
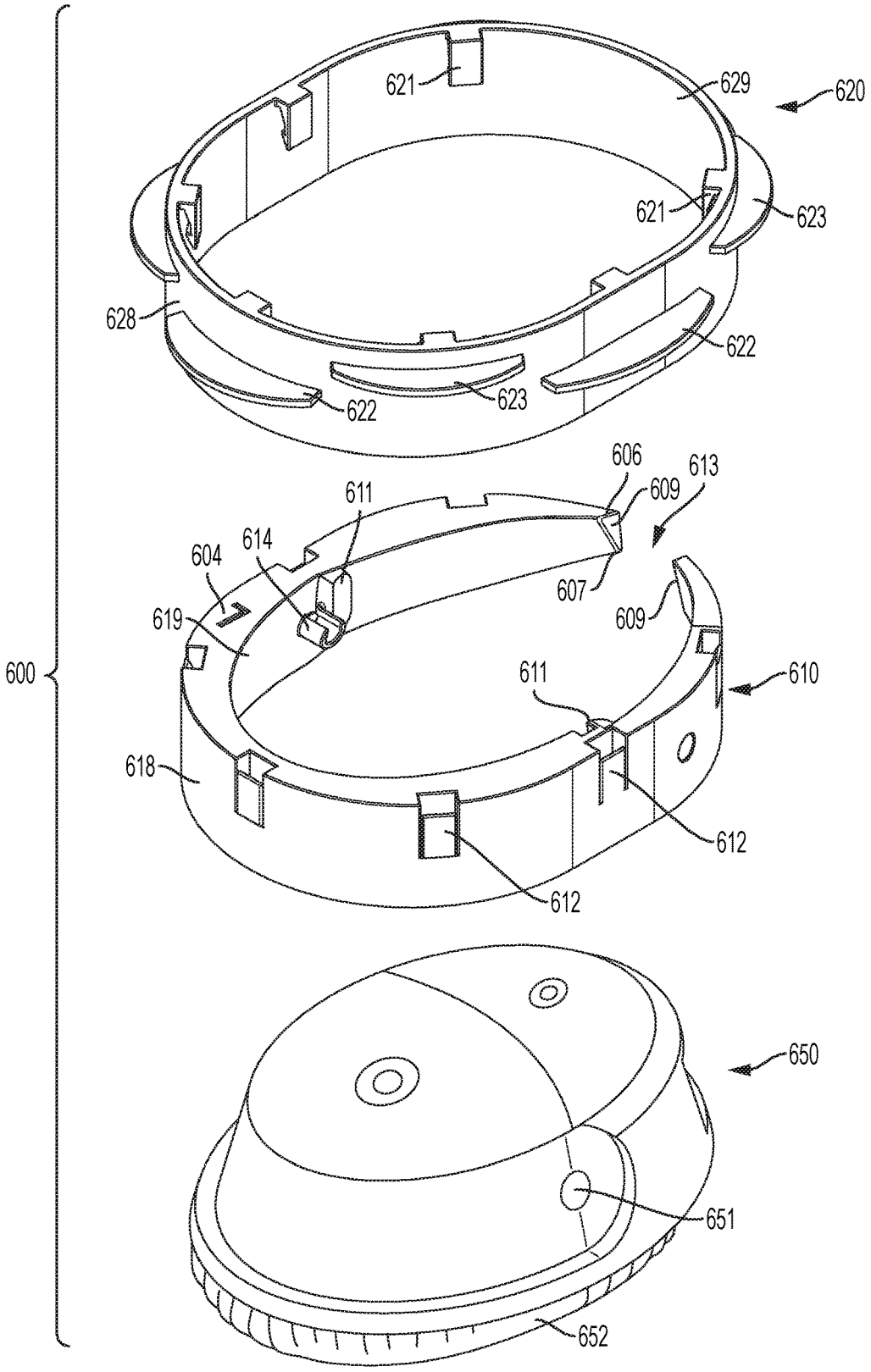
FIG. 6 shows an exploded view of a left audio component assembly, in one embodiment of the disclosure.

With reference now to FIGS. 5 and 6, exploded views of right audio component assembly 500 and left audio component assembly 600, respectively, are illustrated.

FIG. 5 is an exploded view of right audio component assembly 500, in one embodiment of the disclosure. As shown, right audio component assembly 500 includes a right earpiece 550 surrounded by an inner ring 510, which is surrounded by an outer ring 520. Right audio component assembly 500 is for the right ear of a wearer and is accordingly stamped with corresponding indicia 504, such as the letter "R," to assist in proper installation.

Earpiece 550 includes an earcup 552 and a pair of apertures 551 (only one of which is visible in FIG. 5). Apertures 551 would ordinarily receive a pair of corresponding pegs formed on a retaining member (e.g., element 202 of FIG. 2) of a headband (e.g., element 201 of FIG. 2) on which earpiece 550 is rotatably disposed. However, in this embodiment, apertures 551 receive pegs 514 of inner ring 510, as discussed further below.

Inner ring 510 is a generally annular member formed, e.g., of polyvinyl chloride (PVC) or other rigid but slightly flexible material, so as to permit the interior of inner ring 510 to stretch open and around earpiece 550 and couple with earpiece 550. To accomplish this, inner ring 510 includes a pair of pegs 514 formed on opposing sides of the interior surface 519 of inner ring 510, which are received by apertures 551 of earpiece 550, so as to secure earpiece 550 in place within inner ring 510.

The contours of interior surface 519 of inner ring 510 are designed to provide a snug fit around earpiece 550.

In this embodiment, inner ring 510 also includes one or more projections 511 formed on interior surface 519, although, in alternative embodiments, only one of projections 511 and pegs 514, and not both, is employed. Projections 511 enhance the friction fit of earpiece 550 within inner ring 510 for further security.

Inner ring 510 has seven locking tabs 512 and four guide slots 516 formed on its exterior surface 518, which respectively receive seven corresponding locking slots 521 and four corresponding guide tabs 526 of outer ring 520, as discussed further below. Other implementations may have different numbers of corresponding tabs and slots.

It can be seen that inner ring 510 has a discontinuous annular form, with an opening 513 formed at one end that provides space for an electrical cable (not shown in FIG. 5) that is connected to earpiece 550.

Outer ring 520 is a generally annular member formed, e.g., of polyvinyl chloride (PVC) or other rigid but slightly flexible material, so as to permit the interior surface 529 of outer ring 520 to couple snugly with exterior surface 518 of earpiece 550. Seven locking slots 521 are disposed around interior surface 529 and are adapted to provide an interference fit with the corresponding locking tabs 512 of inner ring 510, to secure outer ring 520 around inner ring 510. In addition, four guide tabs 526 are also disposed around interior surface 529 and are adapted to engage with the corresponding guide slots 516 of inner ring 510 to guide the inner and outer rings together with proper relative orientation such that the corresponding locking tabs 512 and locking slots 521 engage properly.

Outer ring 520 includes a first set of flanges 522 and a second set of flanges 523 projecting from exterior surface 528. Flanges 522 and 523 lie in two different planes, respectively. Flanges 522, 523 retain right audio component assembly 500 in place within aperture 301 by interference fit, due to the additional width created by flanges 522, 523 that prevents flanges 522, 523 from passing through aperture 301, while the exterior surface 518 of outer ring 520 freely passes through aperture 301. In this embodiment, when the helmet is in use, all of flanges 522, 523 are disposed on one side of aperture 301, between ear plate 102 and aperture 301, whereby the use of two different planes for flanges 522 and flanges 523 enhances retention on the same side of aperture 301, and ear plate 102 biases right audio component assembly 500 in the direction of the head of the wearer. In an alternative embodiment, the planes of flanges 522 and flanges 523 are sufficiently spaced to permit flanges 522 to remain on one side of aperture 301 and flanges 523 to remain on the other side of aperture 301 (i.e., between ear plate 102 and aperture 301), thereby securing right audio component assembly 500 on both sides of aperture 301. In another alternative embodiment, flanges 522, 523 lie in the same plane. Different numbers and locations of flanges 522, 523 may be used in different embodiments.

Turning now to FIG. 6, an exploded view of left audio component assembly 600, in one embodiment of the disclosure, is illustrated. Left audio component assembly 600 is similar to right audio component assembly 500 of FIG. 5, and the features of FIG. 6 generally correspond to like-numbered features of FIG. 5, with the following differences.

Left audio component assembly 600 includes a left earpiece 650 surrounded by an inner ring 610, which is surrounded by an outer ring 620. Left audio component assembly 600 is for the left ear of a wearer and is accordingly stamped with corresponding indicia 604, such as the letter "L," to assist in proper installation.

Unlike right earpiece 550, left earpiece 650 includes an integrated microphone 655 projecting from one end. In this embodiment, the principal differences between assembly 500 and assembly 600 are those distinguishing inner ring 510 from inner ring 610. Inner ring 510 is adapted to interface with right earpiece 550, which does not include an integrated microphone, while inner ring 610 is adapted to interface with left earpiece 650, which includes microphone 655.

Like inner ring 510 of FIG. 5, inner ring 610 has a discontinuous annular form. Unlike inner ring 510 of FIG. 5, which has an opening 513, the discontinuity 613 in inner ring 610 does not have an opening. Rather, the two ends of the inner ring 610 abut one another at the discontinuity 613. It is noted that, in this embodiment, inner ring 510 and inner ring 610 are reversely symmetrical with respect to one another. The location of opening 613 is slightly shifted relative to the location of opening 513, in order to accommodate microphone 655.

In the embodiment of FIGS. 5 and 6, the designs of outer rings 520 and 620 are identical such that those outer rings are completely interchangeable and a single tooling can be used to manufacture both outer rings.

Figure 7:
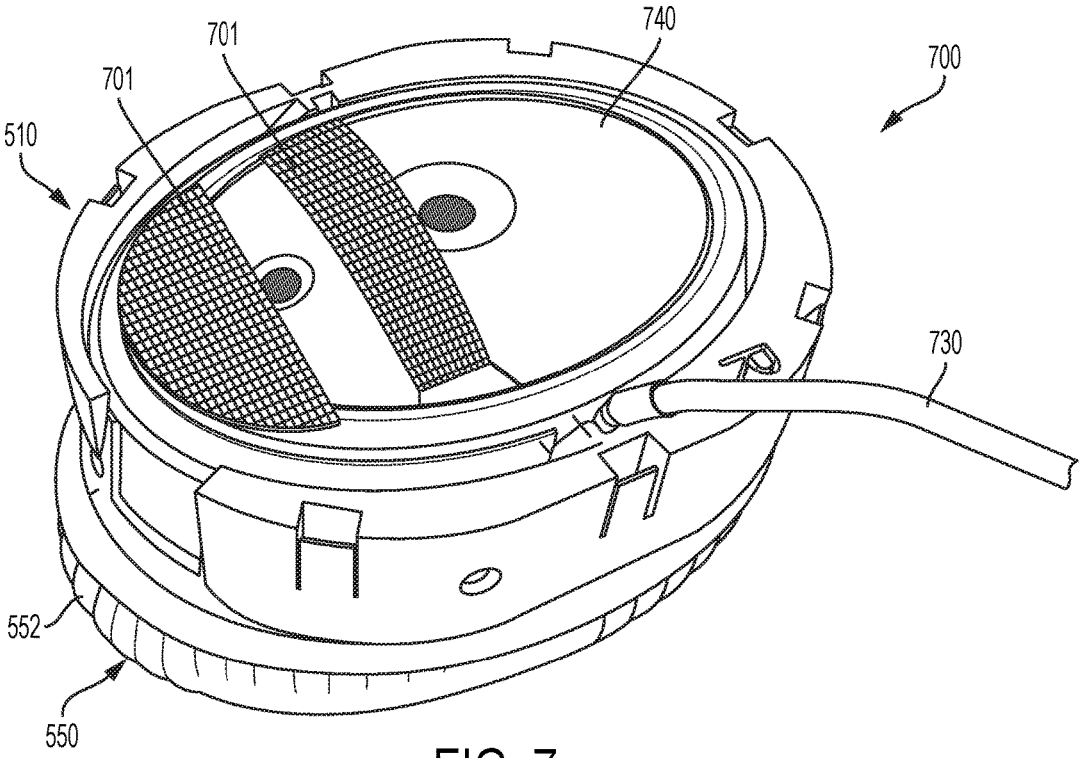
FIG. 7 shows a portion of an assembled right audio component assembly, in one embodiment of the disclosure.

FIG. 7 shows a portion 700 of an assembled right audio component assembly 500, in one embodiment of the disclosure. Portion 700 includes right earpiece 550 and inner ring 510. As shown, earpiece 500 includes wiring 730 coupled to right earpiece 550 and to radio communications or other audio equipment of an aircraft (not shown in FIG. 7), although such connections may be made wirelessly (e.g., via Bluetooth or infrared communications) in alternative embodiments of the disclosure.

In this embodiment, portion 700 also includes one or more strips 701 coupled (e.g., via adhesive) to the outer surface 740 of earpiece 550, although strips 701 may be omitted in some embodiments of the disclosure. One or more strips 701 may be formed from hook-and-loop fastener that engages with a liner on the inside of ear plates 102, to maintain earpiece 550 in place more securely. Alternatively or additionally, one or more strips 701 may be formed from a noise-damping material, a padding for biasing earpiece 550 toward the ear of a user, or other functional material or combination of functional materials.

Figure 8:
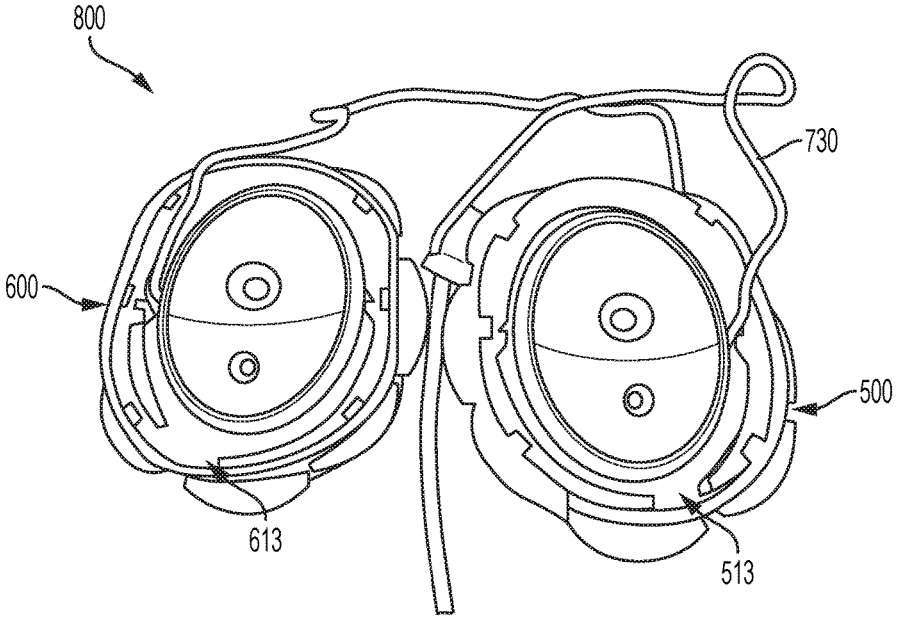
FIG. 8 shows a fully-assembled set of left and right audio component assemblies including microphone, prior to installation in a helmet, in one embodiment of the disclosure.

FIG. 8 shows assembly 800, in one embodiment of the disclosure. Assembly 800 includes right audio component assembly 500 and left audio component assembly 600, wiring 730 coupled to the earpiece of right audio component assembly 500 and to the earpiece of left audio component assembly 600 and to radio communications or other audio equipment of an aircraft (not shown in FIG. 8). As shown, microphone cable 801 passes through opening 613 formed in left audio component assembly 600. Right audio component assembly 500 is shown as having an opening 513 as well.

Figure 9:
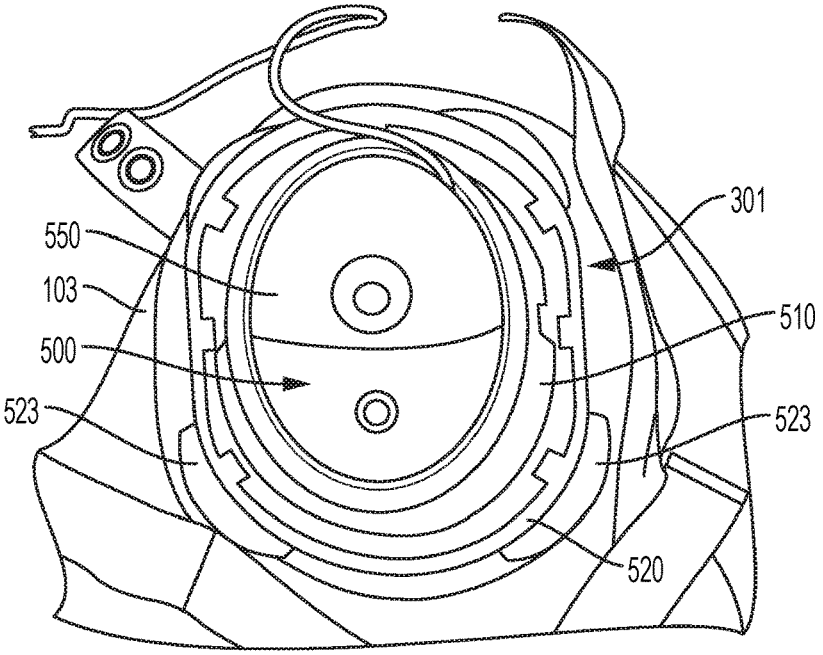
FIG. 9 shows a step of positioning the right audio component assembly within the aperture portion of the retention assembly, in one embodiment of the disclosure.

FIG. 9 depicts right audio component assembly 500 disposed within aperture 301. As shown, right audio component assembly 500 solves the problem in FIG. 4 of aftermarket earpieces 203 being too small to fit snugly within aperture 301 by providing an adapter that includes inner ring 510 and outer ring 520, which holds earpiece 550 securely within aperture 301 of retention assembly 103. This is accomplished by inner ring 510 and outer ring 520 entirely filling the gap between earpiece 550 and aperture 301 to retain earpiece 550 in place, as well as by flanges 523 creating an interference fit with retention assembly 103 so as to prevent right audio component assembly 500 from falling out of aperture 301.

Figure 10:
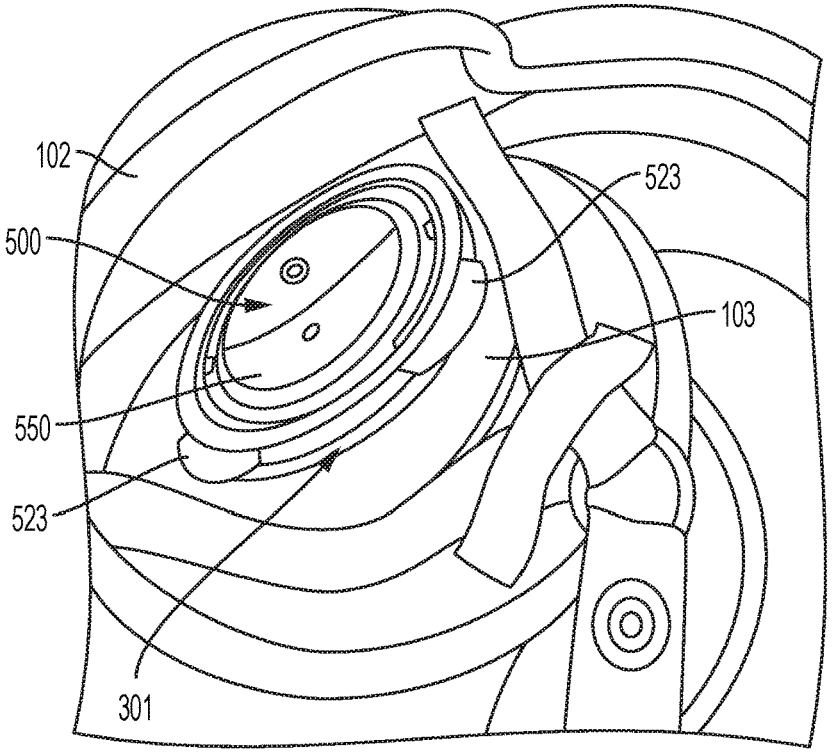
FIG. 10 shows a step of replacing the retention assembly against the outer shell of the helmet to a use-ready position, in one embodiment of the disclosure.

As shown in FIG. 10, once right audio component assembly 500 has been fully assembled and is in place within aperture 301, the right portion of retention assembly 103 is placed against ear plate 102 of helmet 100 in a use-ready position. Thus, flanges 523 are captivated between ear plate 102 and retention assembly 103, preventing travel of right audio component assembly 500 in the direction of the head of the wearer, as well as preventing travel of right audio component assembly 500 in a direction away from the head of the wearer.

Figure 11:
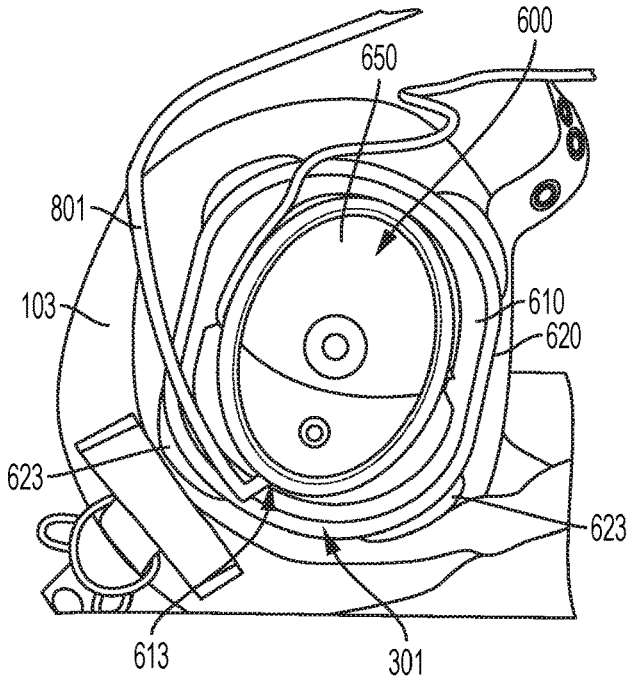
FIG. 11 shows a step of positioning the left audio component assembly within the aperture portion of the retention assembly, in one embodiment of the disclosure.

FIG. 11 depicts left audio component assembly 600 disposed within aperture 301. As shown, left audio component assembly 600 provides an adapter that includes inner ring 610 and outer ring 620, which holds earpiece 650 securely within aperture 301 of retention assembly 103. This is accomplished by inner ring 610 and outer ring 620 entirely filling the gap between earpiece 650 and aperture 301 to retain earpiece 650 in place, as well as by flanges 623 creating an interference fit with retention assembly 103 so as to prevent left audio component assembly 600 from falling out of aperture 301. As shown, microphone cable 801 passes through opening 613 formed in left audio component assembly 600.

Figure 12:
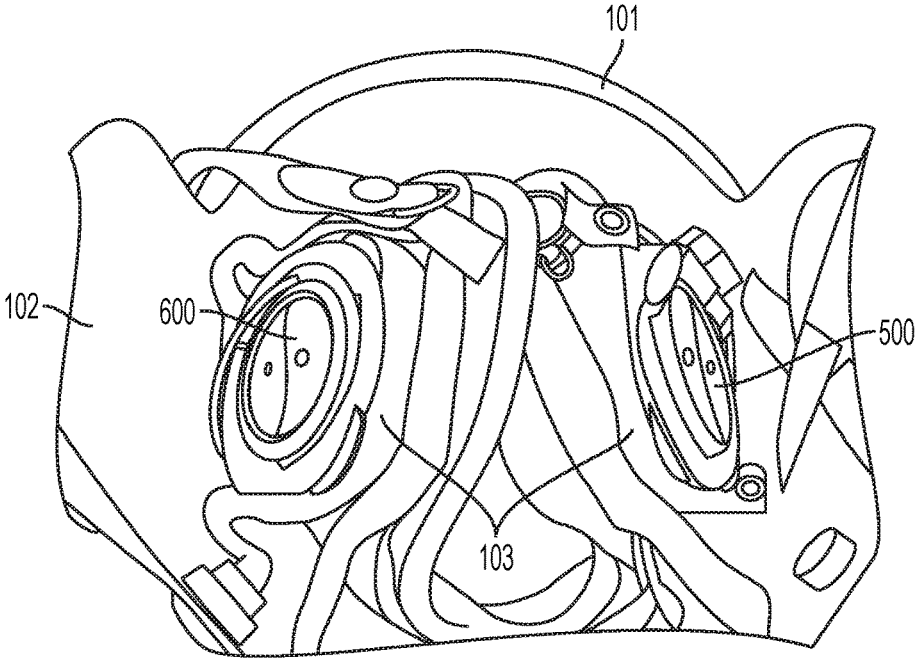
FIG. 12 shows a bottom-rear perspective view of the left and right audio component assemblies, fully assembled within the helmet, in one embodiment of the disclosure.

Turning now to FIG. 12, left audio component assembly 500 and right audio component assembly 600, fully assembled and installed in retention assembly 103 of helmet 100, prior to the left and right portions of retention assembly 103 being placed in a use-ready position, i.e., abutting ear plates 102 of helmet 100.

Figure 13:
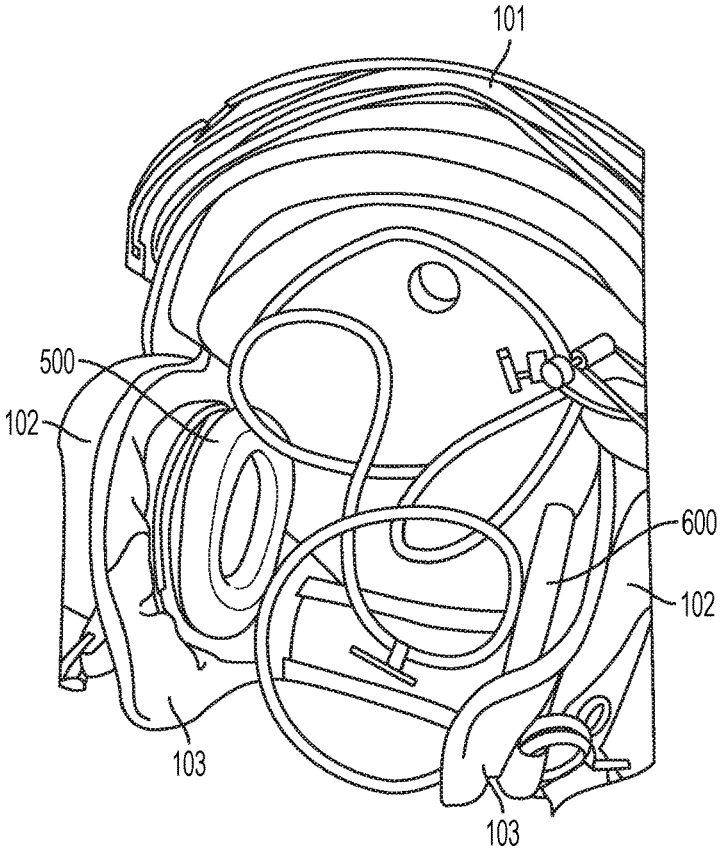
FIG. 13 shows a front perspective view of the left and right audio component assemblies fully assembled within the helmet, in one embodiment of the disclosure.

FIG. 13 shows an interior view of helmet 100 with left audio component assembly 500 and right audio component assembly 600 fully assembled and installed in retention assembly 103 of helmet 100 and in a use-ready position, i.e., with the left and right portions of retention assembly 103 abutting ear plates 102 of helmet 100.

Figure 14:
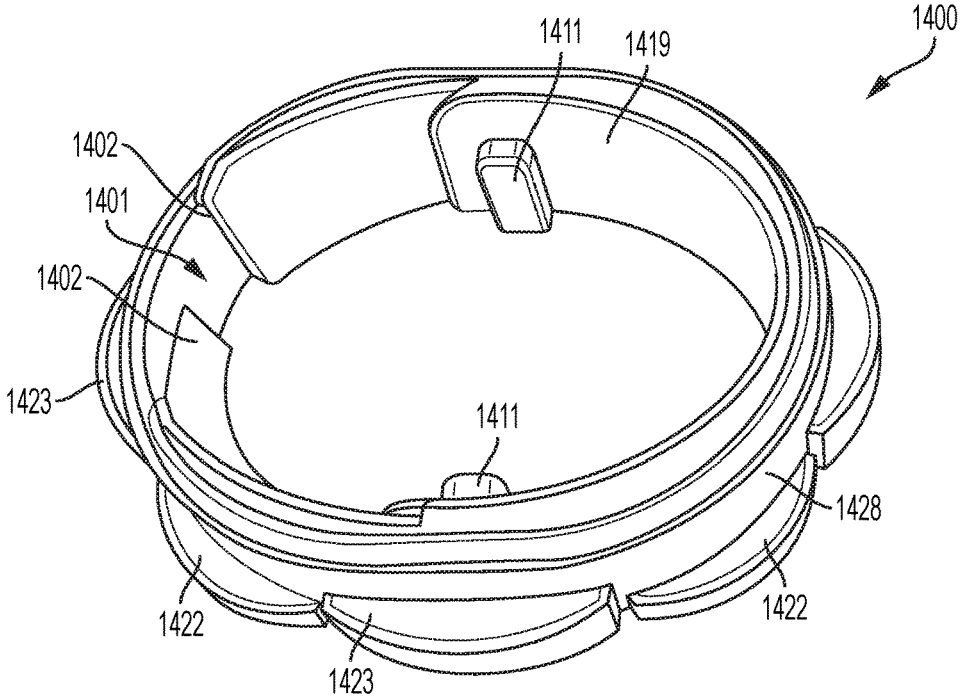
FIG. 14 shows an alternative embodiment of a first portion of a right audio component assembly, in one embodiment of the disclosure.
Figure 15:
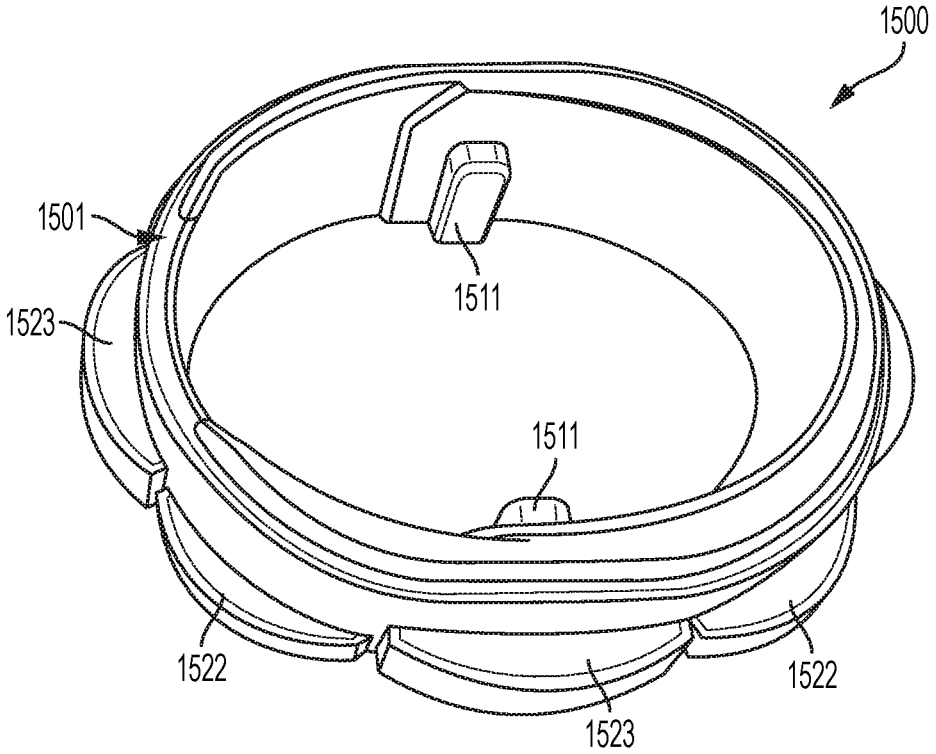
FIG. 15 shows an alternative embodiment of a left audio component assembly, in one embodiment of the disclosure.

FIGS. 14-15 illustrate both right and left audio components, in an alternative embodiment of the disclosure.

As FIG. 14 shows, right audio component assembly 1400 is a unitary member that includes features of both an inner ring (e.g., element 510 of FIG. 5) and an outer ring (e.g., element 520 of FIG. 5). Right audio component assembly 1400 includes one or more projections 1411 formed on interior surface 1419 used to retain an earpiece within right audio component assembly 1440 by friction fit only (since there are no pegs in this embodiment to interface with apertures on the earpiece). Right audio component assembly 1400 includes a first set of flanges 1422 and a second set of flanges 1423 projecting from exterior surface 1428. Flanges 1422 and 1423 lie in two different planes, respectively. Flanges 1422, 1423 generally function substantially as described above with respect to flanges 522, 523 of FIG. 5.

Right audio component assembly 1400 has an opening 1401 formed between end portions 1402.

Turning now to FIG. 15, in this alternative embodiment, left audio component assembly 1500 is a unitary member that includes features of both an inner ring (e.g., element 610 of FIG. 6) and an outer ring (e.g., element 620 of FIG. 6). Left audio component assembly 1500 is similar to right audio component assembly 1400 of FIG. 14, except that opening 1501 of left audio component assembly 1500 permits a microphone cable (not shown) to extend through opening 1501.

Although elements 1400 and 1500 are described in the alternative embodiment above as being unitary components, in alternative embodiments, element 1400 is formed from an inner ring that locks onto a separate outer ring (e.g., as with elements 510 and 520 of FIG. 5), and element 1500 is also formed from an inner ring that locks onto a separate outer ring (e.g., as with elements 610 and 620 of FIG. 6).

Figure 16:
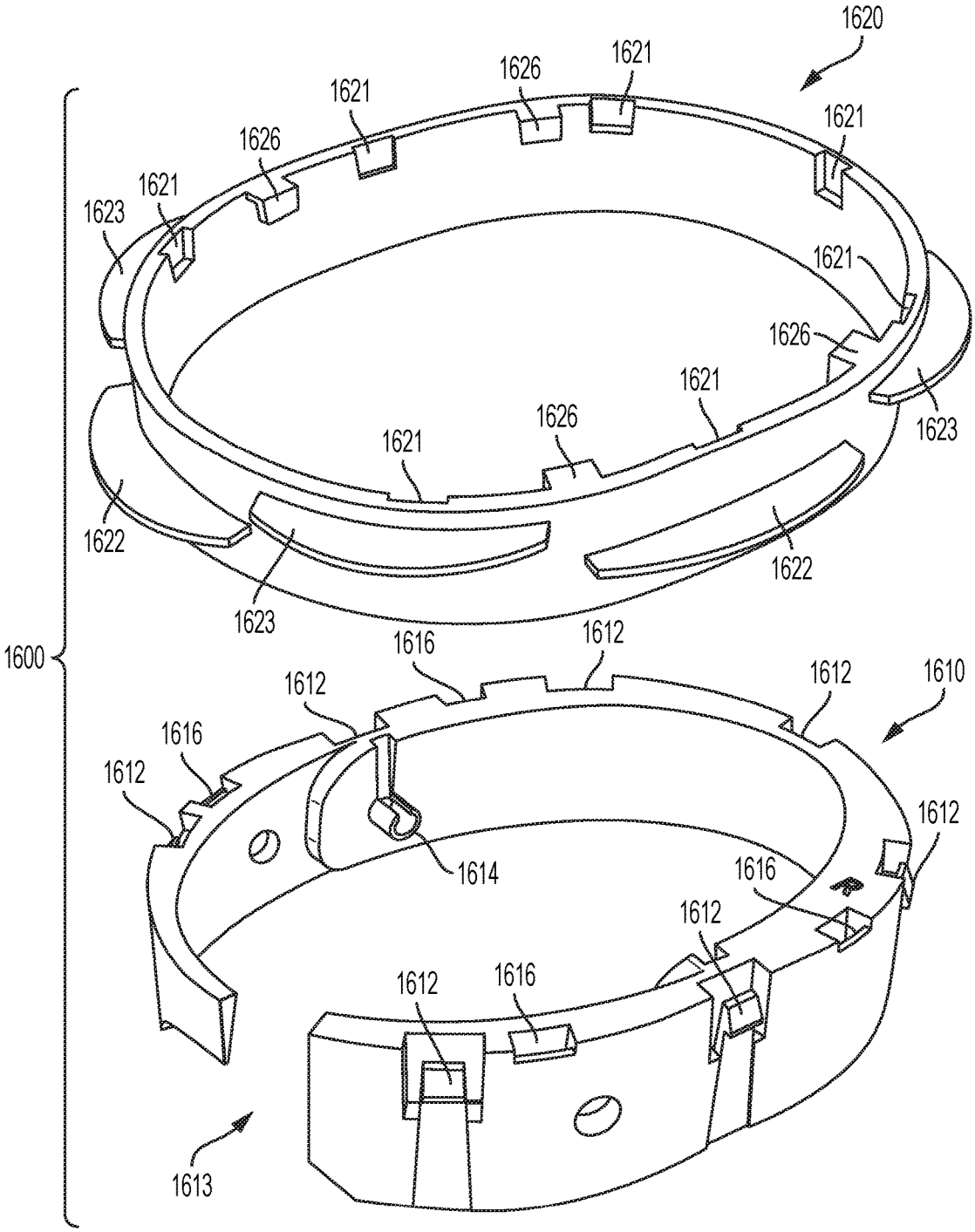
FIG. 16 shows an exploded view of another alternative embodiment of a right audio component assembly.

FIG. 16 shows an exploded view of another alternative embodiment of the right audio component assembly. As shown in FIG. 16, the right audio component assembly 1600 includes an inner ring 1610, which fits within an outer ring 1620. In addition to opening 1613 and two pegs 1614, the inner ring 1610 comprises seven locking tabs 1612 and four guide slots 1616, which respectively receive seven corresponding locking slots 1621 and four corresponding guide tabs 1626 of the outer ring 1620, all of which function similarly to the analogous elements of the inner and outer rings 510 and 520 of FIG. 5.

Figure 17:
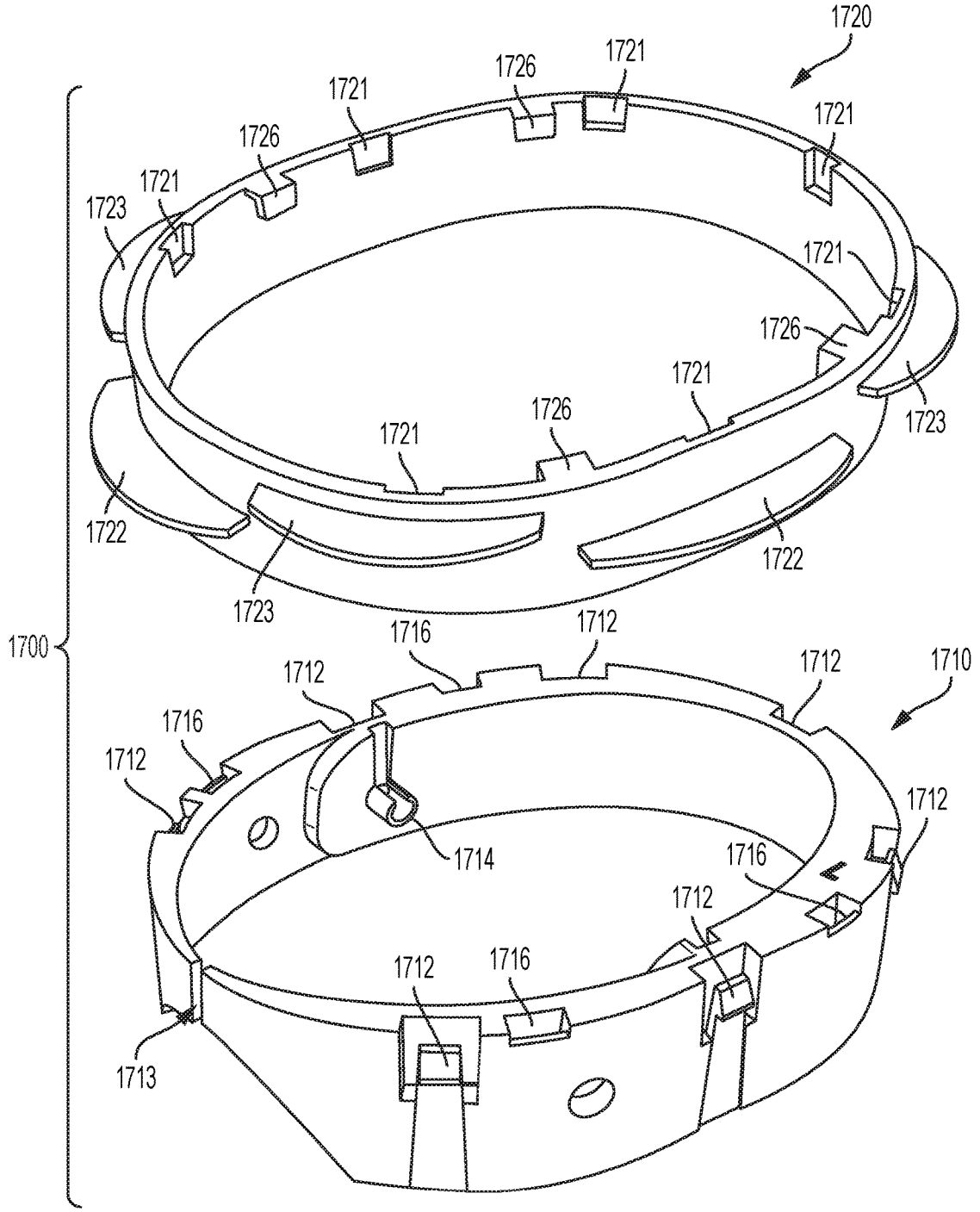
FIG. 17 shows an exploded view of another alternative embodiment of a left audio component assembly.

FIG. 17 shows an exploded view of another alternative embodiment of the left audio component assembly. As shown in FIG. 17, the left audio component assembly 1700 includes an inner ring 1710, which fits within an outer ring 1720. In addition to two pegs 1714, the inner ring 1710 comprises seven locking tabs 1712 and four guide slots 1716, which respectively receive seven corresponding locking slots 1721 and four corresponding guide tabs 1726 of the outer ring 1720, all of which function similarly to the analogous elements of the inner and outer rings 610 and 620 of FIG. 6.

The inner ring 1710 has a discontinuous annular form, with a narrow gap 1713 formed at one end that provides the inner ring with some flexibility when mating with the outer ring 1720.

The inner rings 1610 and 1710 and the outer rings 1620 and 1720 of FIGS. 16 and 17 are all formed, e.g., of polyvinyl chloride (PVC) or other rigid but slightly flexible material, so as to permit the outer rings to couple snugly with the exterior surface of the corresponding earpieces (not shown in FIGS. 16 and 17).

The outer rings 1620 and 1720 both include a first set of flanges 1622/1722 and a second set of flanges 1623/1734 projecting from their exterior surfaces, which function similarly to the analogous flanges of the outer rings 520 and 620 of FIGS. 5 and 6.

In the embodiment of FIGS. 16 and 17, the designs of the outer rings 1620 and 1720 are identical such that those outer rings are completely interchangeable and a single tooling can be used to manufacture both outer rings.

Although components (e.g., elements 1610, 1620, 1710, and 1720) of an audio component assembly may be formed from plastic (e.g., injection molded PVC), these components can be made from other materials in alternative embodiments, such as (without limitation) wood, metal, or polystyrene.

In the embodiments described above, the flanges are formed as tabs that project from an outer surface of the audio component assembly. However, in other embodiments, the one or more flanges can take other forms, such as one or more continuous flanges, rims, ridges, or lips disposed around the audio component assembly. Or, a single flanged tab or pair of tabs could be employed, so long as the one or more flanged areas are sized to prevent the audio component assembly from falling out of its respective aperture of the retention member. Accordingly, the term "flange" should be interpreted herein as including any member that increases the width of the audio component assembly in one or more regions to retain the audio component assembly within an apertured retention assembly of a helmet by means of interference fit.

The term "aperture," as used herein in the context of a retention assembly, refers to holes that are generally circular or ovular in shape, as well as holes having other shapes.

Although audio component assemblies are described herein that include an inner ring, outer ring, and earpiece, it should be understood that an audio component assembly consistent with embodiments of the disclosure may include fewer than all of these components and/or additional components. The term "adapter," as used herein, refers to a set of one or more components of an audio component assembly, excluding the audio components (e.g., earpieces, microphone, and wiring), where the adapter is used to install these audio components into the apertured retention assembly of a helmet.

Although a number of features of embodiments of the disclosure are shown in the figures herein as having sharp corners, it should be understood that such sharp corners could alternatively be rounded, in alternative embodiments of the disclosure.

It should be understood that various changes in the details, materials, and arrangements of the parts which have been described and illustrated in order to explain the nature of this disclosure may be made by those skilled in the art without departing from the scope of the disclosure.

Reference herein to "one embodiment" or "an embodiment" means that a particular feature, structure, or characteristic described in connection with the embodiment can be included in at least one embodiment of the disclosure. The appearances of the phrase "in one embodiment" in various places in the specification are not necessarily all referring to the same embodiment, nor are separate or alternative embodiments necessarily mutually exclusive of other embodiments.

Although the disclosure has been described using relative terms such as "front," "back," "top," "bottom," "over," "above," "under" and the like in the description and in the claims, such terms are used for descriptive purposes and not necessarily for describing permanent relative positions. It is understood that the terms so used are interchangeable under appropriate circumstances such that the embodiments of the disclosure described herein are, for example, capable of operation in other orientations than those illustrated or otherwise described herein.

Although the disclosure is described herein with reference to specific embodiments, various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure. Any benefits, advantages, or solutions to problems that are described herein with regard to specific embodiments are not intended to be construed as a critical, required, or essential feature or element of any or all the claims.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the disclosure.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Although the disclosure has been set forth in terms of the exemplary embodiments described herein and illustrated in the attached documents, it is to be understood that such disclosure is purely illustrative and is not to be interpreted as limiting. Consequently, various alterations, modifications, and/or alternative embodiments and applications may be suggested to those skilled in the art after having read this disclosure. Accordingly, it is intended that the disclosure be interpreted as encompassing all alterations, modifications, or alternative embodiments and applications as fall within the true spirit and scope of this disclosure.

It will be further understood that various changes in the details, materials, and arrangements of the parts which have been described and illustrated in order to explain the nature of this disclosure may be made by those skilled in the art without departing from the scope of the disclosure as expressed in the following claims.

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. An adapter set for mounting at least one earcup into an apertured retention assembly for a helmet, the adapter set comprising:

a first inner ring adapted to be detachably coupled to a first earcup; and a first outer ring adapted to be detachably coupled (i) to the first inner ring and (ii) within a first aperture formed in the retention assembly, wherein:

the first earcup is not designed to be independently integrated into the first aperture;

first and second sets of flanges are disposed on an outer surface of the first outer ring;

the first set of flanges lies in a first plane;

the second set of flanges lies in a second plane different from, but parallel to the first plane; and the first and second sets of flanges are adapted to retain the first outer ring by interference fit within the first aperture with the first set of flanges configured on one side of material of the retention assembly forming the first aperture and the second set of flanges configured on an opposite side of the material of the retention assembly forming the first aperture.

2. The adapter set of claim 1, wherein the first inner ring is adapted to retain the first earcup therein by means of at least one projection or peg protruding from an inner surface of the first inner ring.

3. The adapter set of claim 1, wherein the first inner ring is a discontinuous annular member formed of rigid plastic and having an opening formed therein.

4. The adapter set of claim 3, wherein:

the first earcup includes a microphone, and the opening is adapted to receive the microphone therethrough.

5. The adapter set of claim 2, wherein the at least one projection or peg includes one or more projections adapted to retain the first earcup by friction fit.

6. The adapter set of claim 2, wherein:

the at least one projection or peg includes one or more pegs, and the first earcup is adapted to receive the one or more pegs to retain the first earcup by interference fit.

7. The adapter set of claim 1, wherein:

the first inner ring has a plurality of slots formed therein, and the first outer ring has formed therein a plurality of tabs adapted to couple with the slots so as to retain the first inner ring by interference fit.

8. A method for using an adapter set to mount at least one earcup into an apertured retention assembly for a helmet, the method comprising:

(a) retaining a first earcup within a first inner ring of the adapter set; and (b) retaining a first outer ring of the adapter set by interference fit within a first aperture formed in the retention assembly; and (c) detachably coupling the first inner ring within the first outer ring, wherein:

the first earcup is not designed to be independently integrated into the first aperture;

first and second sets of flanges are disposed on an outer surface of the first outer ring;

the first set of flanges lies in a first plane;

the second set of flanges lies in a second plane different from, but parallel to the first plane; and the interference fit is produced by the first and second flanges disposed on the outer surface of the first outer ring with the first set of flanges configured on one side of material of the retention assembly forming the first aperture and the second set of flanges configured on an opposite side of the material of the retention assembly forming the first aperture.

9. The method of claim 8, wherein the first earcup is retained within the first inner ring by means of at least one projection or peg protruding from an inner surface of the first inner ring.

10. The method of claim 8, wherein the first inner ring is a discontinuous annular member formed of rigid plastic and having an opening formed therein.

11. The method of claim 10, wherein:

the first earcup includes a microphone, and further comprising receiving the microphone through the opening.

12. The method of claim 9, wherein the first earcup is retained within the first inner ring by friction fit using the at least one projection or peg.

13. The method of claim 9, wherein:

the at least one projection or peg includes one or more pegs, and further comprising:

the first earcup receiving the one or more pegs to retain the first earcup within the first inner ring by interference fit.

14. The method of claim 8, wherein:

the first inner ring has a plurality of slots formed therein, and the first outer ring has formed therein a plurality of tabs adapted to couple with the slots so as to retain the first inner ring by interference fit.

15. The method of claim 8, wherein the flanges in the first set are staggered with respect to the flanges in the second set around the outer surface of generally annular member.

16. The adapter set of claim 1, further comprising:

a second inner ring adapted to be detachably coupled to a right earcup; and a second outer ring adapted to be detachably coupled (i) to the second inner ring and (ii) within a second aperture formed in the retention assembly, wherein:

the first earcup is a left earcup;

the first inner ring is specifically designed to retain the left earcup;

the second inner ring is specifically designed to retain the right earcup and has a different shape from the first inner ring; and the first outer ring is identical to and interchangeable with the second outer ring.

17. The adapter set of claim 1, wherein the flanges in the first set are staggered with respect to the flanges in the second set around the outer surface of generally annular member.

18. An adapter set for mounting at least one earcup into an apertured retention assembly for a helmet, the adapter set comprising:

a first inner ring adapted to be detachably coupled to a first earcup;

a first outer ring adapted to be detachably coupled (i) to the first inner ring and (ii) within a first aperture formed in the retention assembly, wherein the first earcup is not designed to be independently integrated into the first aperture;

a second inner ring adapted to be detachably coupled to a right earcup; and a second outer ring adapted to be detachably coupled (i) to the second inner ring and (ii) within a second aperture formed in the retention assembly, wherein:

the first earcup is a left earcup;

the first inner ring is specifically designed to retain the left earcup;

the second inner ring is specifically designed to retain the right earcup and has a different shape from the first inner ring; and the first outer ring is identical to and interchangeable with the second outer ring.

* * * * *